US012268320B2

(12) United States Patent
Kitson

(10) Patent No.: US 12,268,320 B2
(45) Date of Patent: Apr. 8, 2025

(54) HEAD PILLOW APPARATUS WITH NECK SUPPORT, SHOULDER CAVITY AND HEIGHT ADJUSTABILITY

(71) Applicant: George A. S. Kitson, Winnipeg (CA)

(72) Inventor: George A. S. Kitson, Winnipeg (CA)

( * ) Notice: Subject to any disclaimer, the term of this patent is extended or adjusted under 35 U.S.C. 154(b) by 309 days.

(21) Appl. No.: 17/872,396

(22) Filed: Jul. 25, 2022

(65) Prior Publication Data

US 2024/0023734 A1 Jan. 25, 2024

(51) Int. Cl.
*A47G 9/10* (2006.01)

(52) U.S. Cl.
CPC ..... *A47G 9/109* (2013.01); *A47G 2009/1018* (2013.01)

(58) Field of Classification Search
CPC .. A47G 9/10; A47G 9/109; A47G 2009/1018; A47G 9/1081
See application file for complete search history.

(56) References Cited

U.S. PATENT DOCUMENTS

| | | | | |
|---|---|---|---|---|
| 2,835,905 | A | 5/1958 | Tomasson | |
| 4,424,599 | A | 1/1984 | Hannouche | |
| D284,724 | S * | 7/1986 | Clark | D6/601 |
| D292,767 | S | 11/1987 | Challen | |
| 5,014,377 | A | 5/1991 | Dixon | |
| D354,651 | S | 1/1995 | Fitzpatrick | |
| 5,479,667 | A | 1/1996 | Nelson et al. | |
| D396,373 | S | 7/1998 | Reale | |
| D449,483 | S * | 10/2001 | Berke | D6/601 |
| 6,345,401 | B1 * | 2/2002 | Frydman | A47G 9/109 5/636 |
| 8,065,766 | B1 | 11/2011 | Fierro | |
| 8,069,515 | B1 | 12/2011 | Tingey | |
| 8,176,586 | B2 * | 5/2012 | Berke | A47G 9/1081 5/639 |
| D677,096 | S | 3/2013 | Shirian | |
| D758,099 | S | 6/2016 | Pham | |
| D769,649 | S | 10/2016 | Vargas | |
| 9,730,536 | B2 | 8/2017 | Hall | |
| D829,469 | S | 10/2018 | Jensen | |
| D862,115 | S | 10/2019 | Kelber | |
| 11,103,412 | B1 | 8/2021 | O'Brien | |
| 2006/0179572 | A1 | 8/2006 | Rubio | |

(Continued)

*Primary Examiner* — Fredrick C Conley
(74) *Attorney, Agent, or Firm* — Kyle R Satterthwaite; Ryan W Dupuis; Ade & Company Inc.

(57) ABSTRACT

A novel head pillow, at a top-frontal region thereof, includes a forwardly protruding neck-support ledge of overlying relation to an undercut shoulder cavity. A substantially flat plateau at the head pillow's topside extends rearwardly from a transitional top-front corner of the neck-support ledge, which curves downwardly to a front face of the neck-support ledge. Rearwardly of the plateau, the topside of the pillow also features a downwardly and rearwardly sloped mid-region of upward concavity. A bottom insert is selectively receivable in a bottom cavity of the head pillow to adjust an effective working height thereof. The novel head pillow design avoids pressure on the shoulder socket, and supports vertebrae C1 through C7, T1 and T2 for restorative rest of associated muscles. The profiled topside of the pillow cradles the head, and allows neck elongation for improved blood flow, all while maintaining an optimal straight neck posture.

19 Claims, 4 Drawing Sheets

(56) References Cited

U.S. PATENT DOCUMENTS

| | | | | |
|---|---|---|---|---|
| 2011/0078860 | A1* | 4/2011 | Sun | A47G 9/10 5/636 |
| 2014/0288305 | A1* | 9/2014 | Shi | C07D 401/14 546/2 |
| 2015/0047646 | A1* | 2/2015 | Marinkovic | A61H 1/008 606/240 |

* cited by examiner

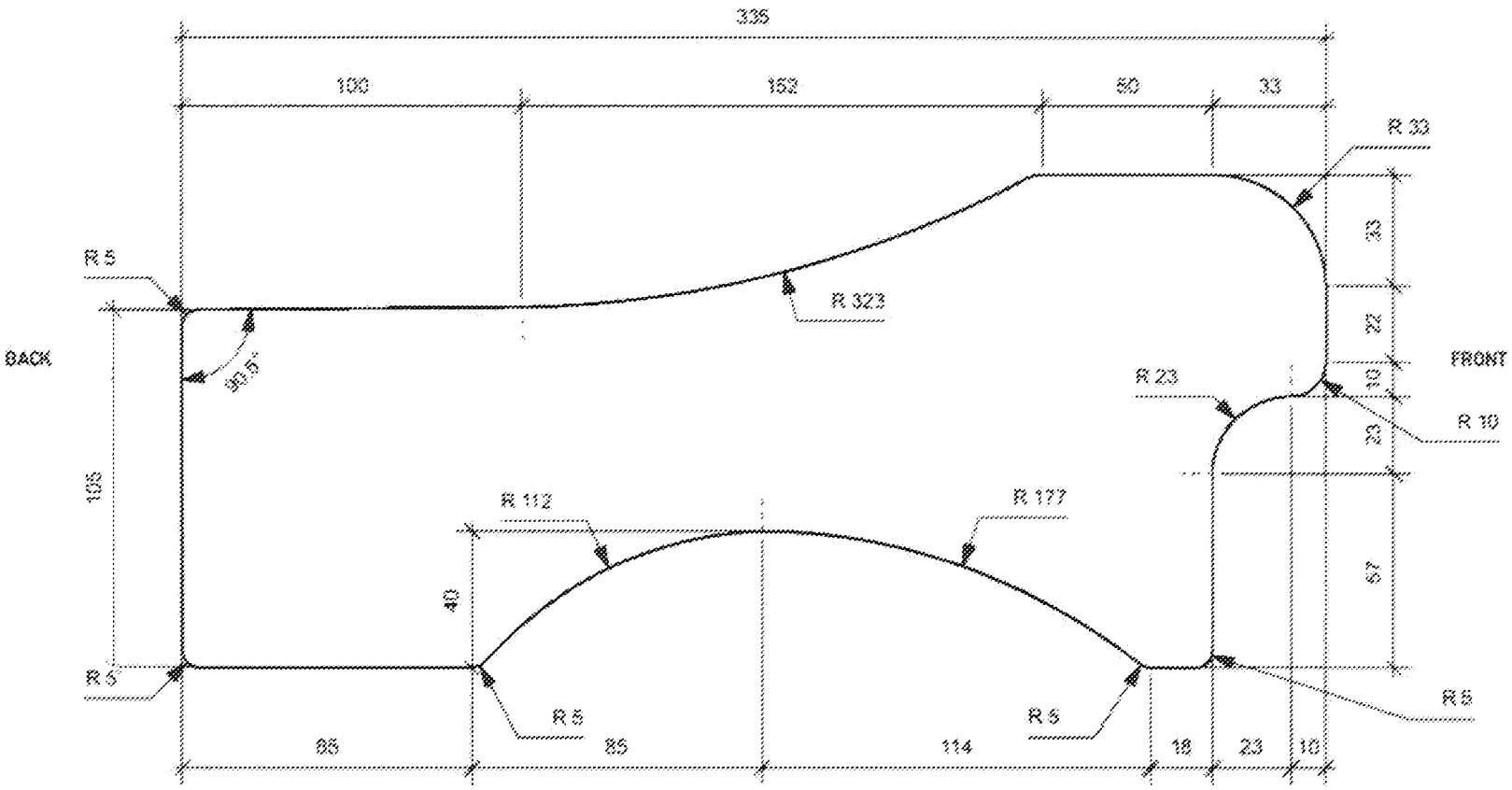
FRONT
R 10
R 30
R 5
R 23
R 177
R 323
R 112
R 5
R 5
R 5

HEAD PILLOW APPARATUS WITH NECK SUPPORT, SHOULDER CAVITY AND HEIGHT ADJUSTABILITY

FIELD OF THE INVENTION

This application relates generally to the field of pillows, and more particular to posture optimizing pillows intended to help maintain optimal sleeping posture for side sleepers.

BACKGROUND

Many people enjoy laying on their sides or back area while sleeping. They find the position generally comfortable and a good way to obtain either a rest or a good night's sleep. However, there are some who find the pressure that this position places upon their spine, back or shoulders uncomfortable as one's head tilts downward while the spine bends in an unnatural U-shape. As such, many side sleepers quickly resort to tossing and turning even after a short amount of time. Others may place a separate pillow under their neck or lumbar area to provide support when initially falling asleep. However, after a short amount of time, the pillows move apart and become separated.

A significant number of uniquely shaped pillows have been proposed previously in the art, some specifically designed for side sleepers, and others not. Examples of prior pillow designs of varying shape and purpose can be seen, for example, in U.S. Pat. Nos. 2,835,905, 8,069,515, 8,176,586, 9,730,536, 11,103,412, D292767, D354651, D396373, D449483, D677096 and D829469.

Despite these prior endeavors, Applicant believes that there still remains room for improved solutions that can improve the support and comfort for a side sleeper's head, neck, and spine area in an effort to address the deficiencies and discomfort as described above.

SUMMARY OF THE INVENTION

According to one aspect of the invention, there is provided a pillow apparatus comprising:

a head pillow having a front side, a rear side of opposing relation to the front side in a longitudinal direction, a left side, a right side of opposing relation to the left side in a lateral direction perpendicularly transverse to the longitudinal direction, a topside, and an underside of opposing relation to the topside in a height direction lying orthogonally of the longitudinal and lateral directions;

wherein a cross-sectional shape of the head pillow, in a reference plane cutting therethrough in the longitudinal direction and lying parallel to the longitudinal and height directions, is characterized by:

at a top-frontal region of the head pillow that interjoins the topside and the front side, a forwardly protruding neck-support ledge, below which the front side is characterized by a rearwardly recessed shoulder cavity that is of undercut relation to the forwardly protruding neck-support ledge, and that spans from an underside of the forwardly protruding neck-support ledge to the underside of the head pillow;

at said neck-support ledge, a transitional top-front corner that curves convexly forward and downward from a topside of said neck-support ledge to a front face thereof;

at the topside of the head pillow, and extending rearwardly from the transitional top-front corner of the neck-support ledge, a substantially flat plateau; and at the topside of the head pillow, and extending rearwardly from the substantially flat plateau toward the rear side of the head pillow, a downwardly sloped mid-region up upwardly concave curvature.

The cross-sectional shape of the head pillow in said reference plane may be further characterized by a flat rear region spanning rearwardly from the downwardly sloped mid-region to the rear side of the pillow.

Preferably the plateau lies in a plane of substantially parallel relation to the longitudinal and lateral directions.

Preferably at least part of the plateau resides rearwardly of the shoulder cavity.

Preferably the plateau resides nearer to the front face of the neck-support ledge than to a lateral midplane of the head pillow.

Preferably a front facing wall of the shoulder cavity occupies a lateral reference plane, and the plateau is intersected by said lateral reference plane.

Preferably the lateral reference plane intersects said plateau at a front end thereof where said plateau meets the transitional top-front corner.

Preferably the top-front transitional corner, the plateau and the downwardly curved mid-region collectively span more than half of a total length of the head pillow, as measured in the longitudinal direction.

Preferably the underside of the head pillow is characterized by a bottom cavity recessed upwardly therein; the apparatus further comprises a bottom insert selectively insertable into the bottom cavity to modify an effective working height of the head pillow.

Preferably a topside of the bottom insert is of matingly shaped profile to a ceiling of the bottom cavity for receipt of the bottom insert in conforming relation to said ceiling of the bottom cavity.

Preferably the bottom cavity of the head pillow and the bottom insert are of substantially matching cross-sectional shape to one another.

Preferably the bottom insert, in an installed working position thereof in the bottom cavity of the head pillow, fills a substantial entirety of said bottom cavity.

Preferably a bottom of the bottom insert, in an installed working position thereof in the bottom cavity of the head pillow, resides flush with neighbouring surfaces of the underside of the head pillow.

Preferably the bottom insert is a cut-out piece of a foam body of said head pillow.

According to another aspect of the invention, there is provided a pillow apparatus comprising:

a head pillow having a front side, a rear side of opposing relation to the front side in a longitudinal direction, a left side, a right side of opposing relation to the left side in a lateral direction perpendicularly transverse to the longitudinal direction, a topside, and an underside of opposing relation to the topside in a height direction lying orthogonally of the longitudinal and lateral directions;

a bottom cavity recessed upwardly in the underside of the head pillow; and a bottom insert selectively insertable into the bottom cavity to modify an effective working height of the head pillow.

BRIEF DESCRIPTION OF THE DRAWINGS

One preferred embodiment of the invention will now be described in conjunction with the accompanying drawings in which:

FIG. 1A is an exploded perspective view of a pillow set of the present invention, particularly characterized by a novel head pillow and accompanying bottom insert for same, and optionally also including an additional lumbar pillow.

FIG. 1B is an assembled perspective view of the pillow set of FIG. 1, with the bottom insert installed in a bottom cavity of the novel head pillow.

FIG. 4 is a side elevational view of the head pillow, marked with a non-limiting example of possible dimensions for a cross-sectional shape profile thereof, in millimeters.

DETAILED DESCRIPTION

Figure 2A:
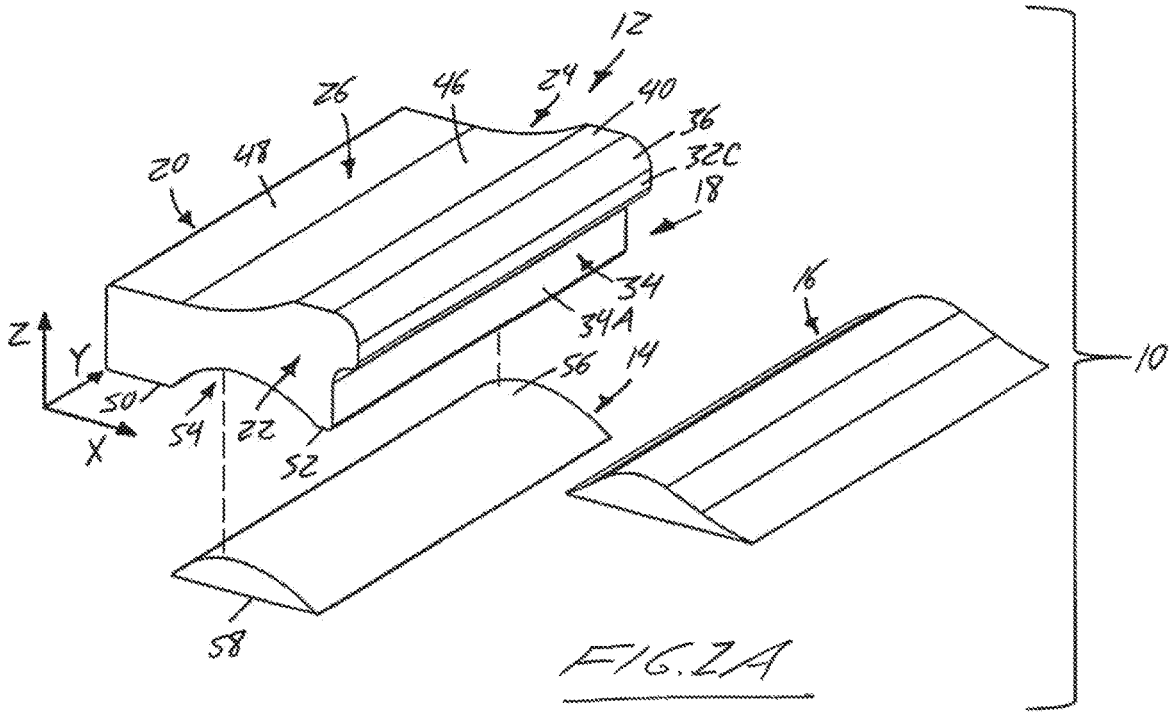
FIG. 2A is a side elevational view of the pillow set in use by a first side sleeper to achieve optimal sleeping posture using all three components of the pillow set.

Referring to FIG. 1, shown therein is one preferred, but non-limiting embodiment, of an inventive pillow set 10 of the present invention, which in this illustrated example is composed of three pieces: a head pillow 12, an accompanying bottom insert 14 selectively receivable in a bottom cavity of the head pillow to adjust an effective working height thereof during use, and a separate lumbar pillow 16 optionally included as part of a bundled pillow set with the head pillow 12 and its bottom insert 14. In other embodiments, the lumbar pillow 16 may optionally be omitted, or acquired separately of the head pillow 12 rather than being included as part of a bundled pillow set. Particular attention is given herein to the novel shape of the head pillow 12, and the novel, but optional, use of the cooperative bottom insert 14 to enable user-adjustment of the effective working height of the head pillow in order to best suit a particular user's anatomy, comfort, mattress firmness, etc.

Any description made herein of the shape of any of the components 12, 14, 16 is given in relation to a three-dimensional reference frame denoted by an X, Y, Z coordinate system schematically shown in the figures, of which the X-axis, Y-axis and Z-axis are all orthogonal of one another. The description is also made with reference to an intended use scenario, where the components are placed atop a substantially horizontal sleep surface (typically, a mattress), in which instance the X and Y axes are horizontal axes lying perpendicular of one another in the horizontal plane of the mattress top, and the Z axis is a vertical axis standing perpendicularly upright from this horizontal plane of the mattress top. The X-axis denotes a longitudinal direction lying lengthwise of the mattress, with the head and foot ends of the mattress thus opposing one another in this longitudinal direction. The Y-axis denotes a lateral direction lying widthwise of the mattress, with the opposing long sides of the mattress opposing one another in this lateral direction, and the Z-axis denotes a vertical height direction in which the thickness of the mattress would be measured. It will be appreciated that such specific designations are set only for the purpose of setting a standardized environment and reference frame in which the shape, scale and dimensions of the described components may be properly assessed and understood, and that in actual use, the environment and particular orientation in which the pillow set is placed may deviate from this particular environment and directional reference frame.

The head pillow 12 is embodied by a singular unitary body of foam material (e.g. latex foam) that has a front side 18, a rear side 20, a left side 22, a right side 24, a topside 26, and an underside 28. Of these six sides, the front and rear sides 18, 20 are of opposing relation to one another in the longitudinal direction of the X-axis, the left and right sides 22, 24 are of opposing relation to one another in the lateral direction of the Y-axis, and the topside and underside 26, 28 are of opposing relation to one another in the height direction of the Z-axis. In use, the head pillow 12 is placed atop a sleep surface S on which the user will sleep, which will typically be the top surface of a bed mattress, which is usually a covered top surface of the mattress, where the mattress is overlaid by a fitted sheet. In such position of intended use, the underside 28 of the head pillow 12 of the illustrated embodiment faces and rests atop this sleep surface S.

Figure 3A:
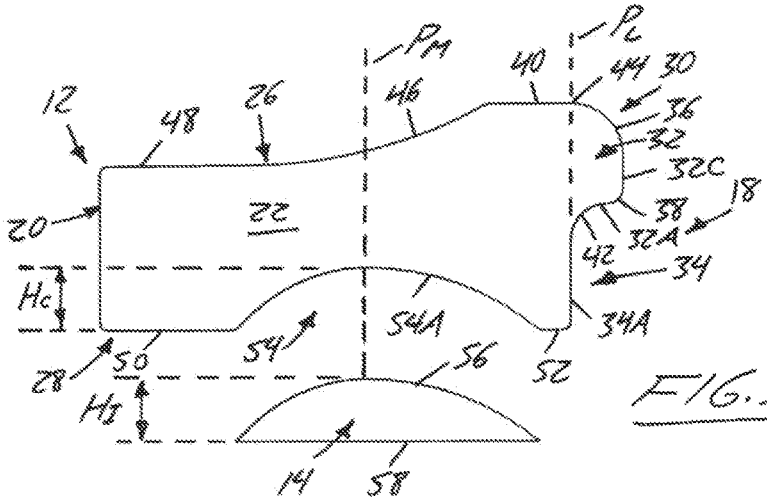
FIG. 3A is an exploded side elevational view of the head pillow and bottom insert.
Figure 3B:
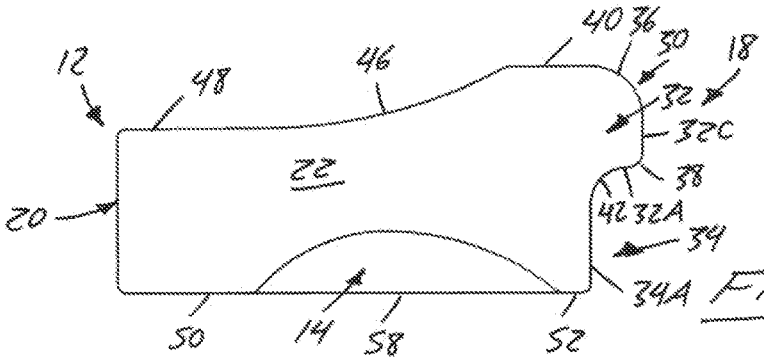
FIG. 3B is an assembled side elevational view of the head pillow and bottom insert.
Figure 5:
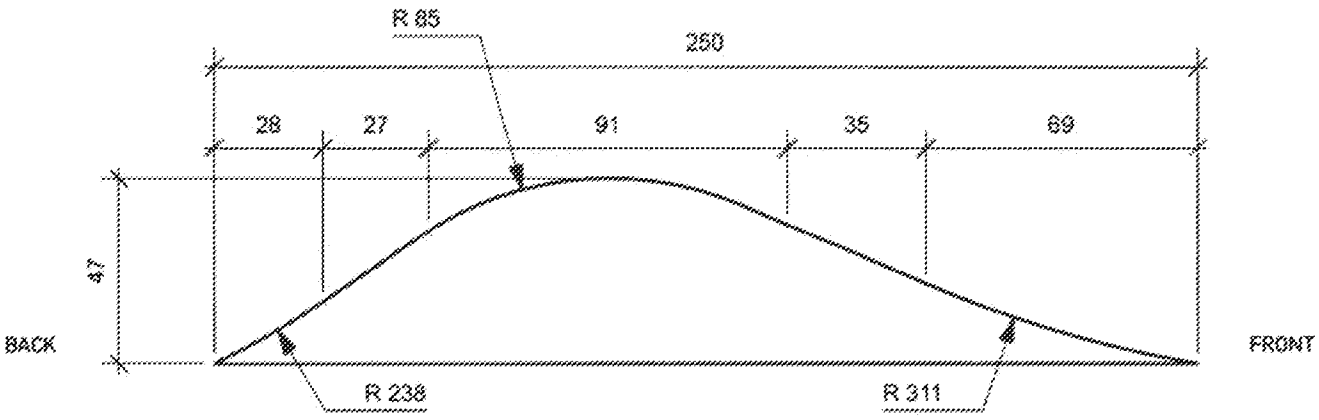
FIG. 5 is a side elevational view of the lumbar pillow, marked with a non-limiting example of possible dimensions for a cross-sectional shape profile thereof, in millimeters.

A novel shape of the head pillow 12 is described herein with reference to a cross-sectional shape profile thereof in a cross-sectional reference plane lying longitudinally of the pillow in parallel relation to the X-Z plane of the X,Y,Z coordinate system, somewhere between the laterally opposing left and right sides 22, 24 of the head pillow 12. In the illustrated embodiment, the cross-sectional shape profile of the head pillow is uniform throughout the full width of the head pillow, whereby this cross-sectional reference plane can be arbitrarily chosen at any location between the left and ride sides. In any case, the described cross-sectional shape profile is preferably at least embodied at a bisecting mid-plane $P_{BM}$ that longitudinally bisects the head pillow 12 in parallel relation to the X-Z plane of the X,Y,Z reference frame and resides equidistance from the left and right sides 22, 24 of the pillow, as this denotes a lateral center of the head pillow where the user's head is most typically expected to rest during use of the pillow. Nonetheless, since the illustrated embodiment of the head pillow has a uniform cross-sectional shape profile throughout the entirety of the head pillow, the cross-sectional shape profile is described with particular reference to the side elevational views FIGS. 3A and 3B, since the uniform cross-section means that the cross-sectional shape profile in any cross-sectional reference plane also matches the side shape profile of the head pillow, as viewed from either the left or right side thereof. Referring to FIG. 3A or 3B, the cross-sectional or side shape profile is therefore now described as follows.

A top-frontal region 30 of the head pillow 12 denotes the region thereof at which the topside 26 and the front side 18 are interjoined with one another. This top-frontal region 30 forms a forwardly protruding neck-support ledge 32, below which the front side is further characterized by a rearwardly recessed shoulder cavity 34 of undercut relation to the forwardly protruding neck-support ledge 32. This shoulder cavity 34 spans from an underside 32A of the neck-support ledge 32 to the underside 28 of the overall head pillow 12. At the neck-support ledge 32 of the top-frontal region 30, a transitional top-front corner 36 of the neck support ledge 32 curves convexly downwardly from the topside 26 of the head pillow 12 to a front face 32C of the neck-support ledge 32 at the front side 18 of the head pillow 12. A transitional bottom-front corner 38 of the neck support ledge 32 curves convexly rearward from the front face 32C of the neck-support ledge 32 to the underside 32A thereof, albeit with a smaller radius of curvature than the top-front transitional corner 36 in the illustrated example.

At the topside 26 of the head pillow 12, a substantially flat plateau 40 joins flush with a rear end of the transitional top-front corner 36 of the neck-support ledge 32, and spans rearwardly therefrom. In the illustrated example, this flat plateau 40 lies in a plane generally parallel to the X-Y plane of the X,Y,Z coordinate system, and thus resides in a generally horizontal plane when the head pillow is placed atop a horizontal sleep surface. The shoulder cavity 34 features a front-facing wall 34A spanning from the underside 28 of the overall head pillow 10 up to the underside 32A of neck support ledge 32, which doubles as the ceiling of the shoulder cavity 34. A concavely rounded transition corner 42 smoothly interjoins the front facing wall 34A and ceiling 32A of the shoulder cavity 34. In the illustrated example, the top-front transitional corner 36 meets with a front end of the flat plateau 40 meet at a lateral reference plane $P_L$ of parallel relation to the Y-Z plane of the X,Y,Z coordinate system. In the illustrated example, the front-facing wall 34A of the shoulder cavity 34 occupies this same lateral reference plane $P_L$, whereby the meeting point 44 of the top-front corner 36 and the flat plateau 40 resides nearer to the front-facing wall 34A of the shoulder cavity 34 than to the front face 32C of the neck-support ledge 32.

Extending rearwardly from the flat plateau 40 toward the rear side 20 of the head pillow, the topside 26 of the head pillow 12 features a downwardly sloped mid-region 46 having an upwardly concave curvature. Finally, completing the topside 26 of the head pillow, is a flat rear region 48 spanning rearwardly from the downwardly sloped mid-region to the rear side 20 of the pillow. In the illustrated example, moving in a rearward direction from the flat plateau 40 to the rear end 20 of the head pillow 12, the height or elevation of the pillow's topside 26, measured along the Z-axis, only ever decreases or plateaus, and never increases. The head pillow's greatest height or elevation thus exists at the flat plateau 40 thereof, which resides nearer to both the front face 32C of the neck-support ledge 32 and nearer to the lateral reference plane $P_L$ than to a lateral midplane $P_M$ that lies parallel to the Y-Z plane of the X,Y,Z coordinate system at a midpoint half way between the front face 32C of the neck-support ledge 32 and the opposing rear end 20 of the pillow. The curved mid-region 46 spans from the flat plateau 40 rearwardly past this lateral midplane $P_M$, such that part of the curved mid-region resides rearwardly of the lateral midplane $P_M$. As a result, the top-front transitional corner 36, flat plateau 40 and curved mid-region 46 collectively span more than half of the pillow's total length in the longitudinal direction of the X-axis, for example preferably somewhere between 60 and 90 percent of the pillow's total length, and more particularly about 70% thereof in the illustrated example.

In the illustrated embodiment, the underside 28 of the head pillow 12 is not entirely flat, though it may be entirely flat in other embodiments that lack the cooperating bottom insert 14. In the preferred embodiment shown in the drawings, the underside 28 of the head pillow 12 instead features a flat rear seating surface 50, a flat front seating surface 52 of coplanar relation to the flat rear surface, and a bottom cavity 54 that resides between the two seating surfaces 50, 52. The two seating surfaces 50, 52 occupy a lowermost plane of the head pillow 12 that is of parallel relation to the X-Y plane of the X,Y,Z coordinate system. By contrast, the bottom cavity 54 is recessed from the lowermost plane shared by the seating surfaces in an upward direction toward the opposing topside 26 of the head pillow 12. In the illustrated example, the bottom cavity 54 is of a curved profile in the cross-sectional reference plane, as evidenced in the drawings by a downwardly concave ceiling 54A of the bottom cavity 54.

Turning attention from the head pillow 12 to the accompanying bottom insert 14, the bottom insert may likewise be formed of a singular unitary body of foam material, for example latex foam. The bottom insert has a curved top 56 of upwardly convex character of matching curvature profile to the concave ceiling 54A of the bottom cavity 54. In the height direction of the Z-axis, the curved top 56 of the bottom insert 14 is opposed by a flat bottom 58 thereof. In the illustrated example, using the term width to denote measurements taken in the lateral direction of the Y-axis, the bottom cavity 54 spans the entire width of head pillow 12, and the bottom insert 14 has a matching width of equal measure thereto. Accordingly, when the bottom insert 14 is received in an installed position in the bottom cavity 54 of the head pillow 12, the bottom insert 14 spans the full width of the head pillow 12 at the underside thereof. Since the ceiling 54A of the head pillow's bottom cavity 54 and the curved top 56 of the bottom insert 14 are of matching curvature profile, they abut one another in conforming fashion in the installed position of the bottom insert 14, as shown in FIGS. 1B and 3B. Accordingly, any weight borne by the head pillow 12 is distributed over the full surface area of the insert's curved top 56.

In the illustrated embodiment, the cross-sectional shape profile and dimensions of the bottom insert 14 are identical to that of the bottom cavity 54 of the head pillow, in which case the bottom insert 14 may be embodied by a cut-out piece of the head's pillow's foam body, for example having been factory cut therefrom during production of the pillow set. In this embodiment, the flat bottom 58 of the bottom insert 14 thus resides flush with the bottom seating surfaces 50, 52 of the head pillow when the bottom insert 14 is placed in the head pillow's bottom cavity in mating alignment therewith, which denotes an intended working position in which the bottom insert 14 will normally or always be used. In this embodiment, the bottom insert 14, in its intended working position, thus fills the entirety of the head's pillow's bottom cavity 54 in shape conforming relation thereto, and thereby renders the underside of the head pillow 28 effectively flat over the full surface area thereof.

When the bottom insert 14 is used in combination with the head pillow 12 in the working position filling the bottom cavity 54 thereof, the result is that both the bottom 58 of the insert 14 and the two seating surfaces 50, 52 of the head pillow's underside 28 rest atop the sleeping surface S, and the installed bottom insert 14 provides a greater amount of compressive load resistance to the weight of the user's head on the topside of the head pillow 12 compared to the amount of compressive load resistance that is provided by the head pillow 12 when the bottom cavity 54 is empty. Using the term height to denote measurements taken in the height direction of the Z-axis, and the term "working height" to denote an elevation occupied by the topside of the head pillow when laid upon by the user's head and neck to bear the weight thereof, it can be seen by comparison of FIGS. 2A and 2B how this working height varies depending on the presence or absence of the bottom insert 14 in the head pillow's bottom cavity 54.

Figure 2B:
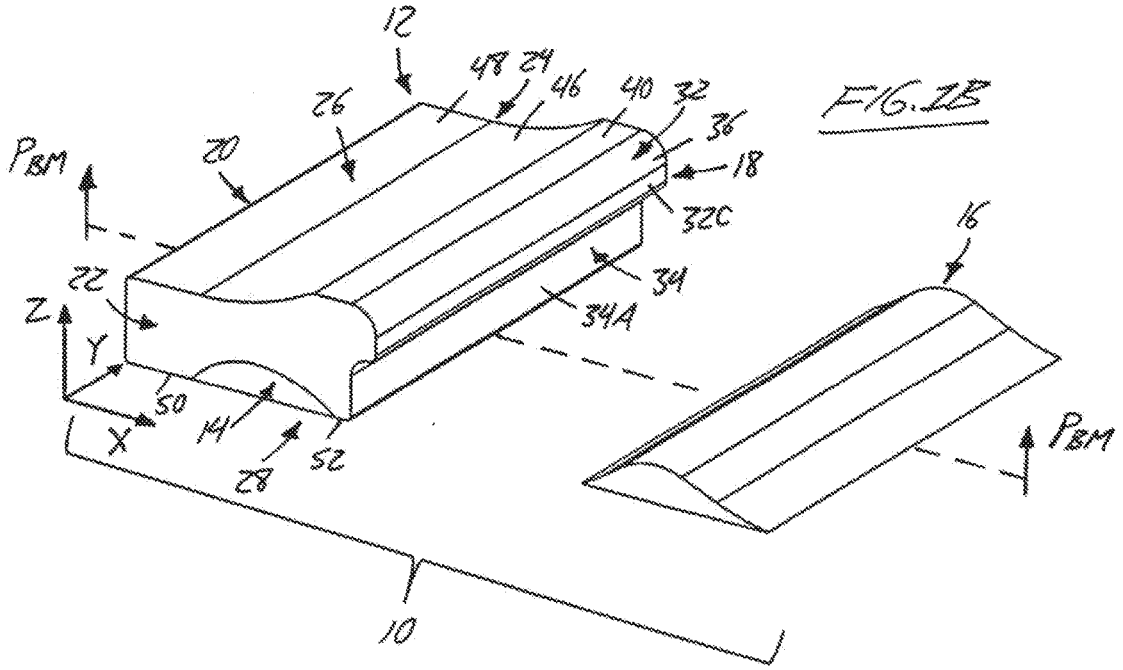
FIG. 2B is a side elevational view of the pillow set in use by a second side sleeper of different anatomical size and/or shape to achieve optimal sleeping posture through use of the head and lumbar pillows alone, without the head pillow's bottom insert.
Figure 2A:
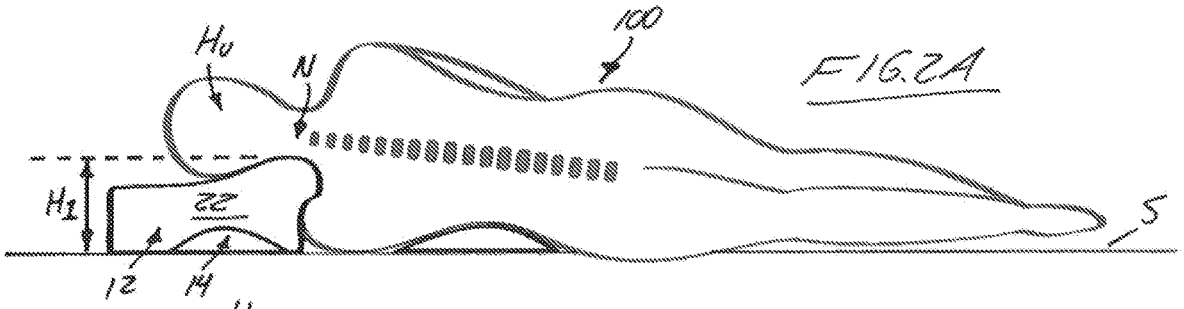
Figure 2B:
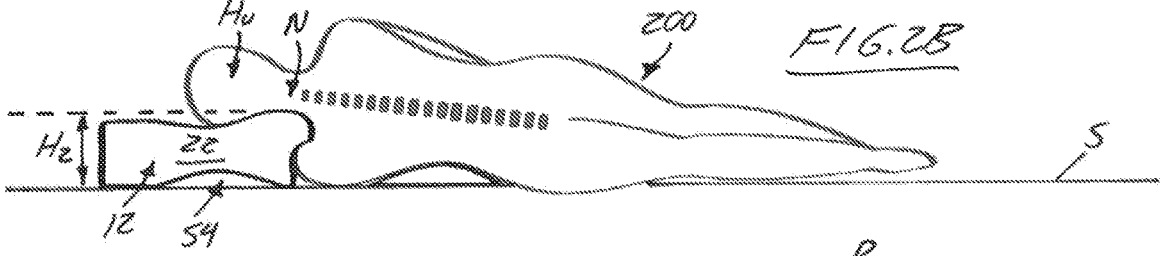

In FIG. 2A, the head pillow 12 and bottom insert 14 are being used by a first side sleeper 100 of greater shoulder breadth and head width than a second side sleeper 200 shown in FIG. 2B, a result of which is that a comfortable straight-neck posture of the first side sleeper 100 equates to a more elevated head position than that which corresponds to a comfortable straight-neck posture of the second side sleeper 200. The first user is therefore shown using the head pillow 12 and insert 14 in working combination with one another, with the bottom insert 14 mated with the head pillow's bottom cavity in shape-conforming relation thereto in order to reduce the degree to which the plateau 40 and mid region 46 of the head pillow's topside 26 are downwardly depressed by the weight of the user's neck N and head $H_U$ laid thereupon. In this instance, the topside of the neck-support ledge 32 has been depressed down to a first working height $H_1$ of greater elevation than that to which it would have been depressed if the bottom cavity 54 was left empty in the absence of the bottom insert.

To the contrary, the second side sleeper 200, for whom a comfortable straight-neck posture equates to a less elevated head position than the first side sleeper 100, is shown using the head pillow 12 without the bottom insert 14. Here, the empty status of the bottom cavity 54 of the head pillow allows greater collapse of the cavity height $H_C$ to take place under the exerted weight of the user's neck N and head $H_U$ when laid atop the head pillow 12, whereby the topside of the neck support ledge 32 is depressed further downward to a second working height $H_2$ of lesser elevation than the first working height $H_1$. Accordingly, a user can choose between the use the head pillow 12 alone without the insert 14, or use of the head pillow 12 together with the insert 14, according to which of these two options best suits the particular user's anatomy, comfort and mattress firmness: the greater insert-aided filled-cavity working height $H_1$ of the head pillow and insert combination (see FIG. 2A), or the lesser empty-cavity working height $H_2$ (see FIG. 2B) of the head pillow 12 alone. Preferably the difference between the two working heights ($H_1$ minus $H_2$) for a given user is least one inch, and in one non-limiting example, may be approximately two inches.

Having described the novel head pillow, and its working height adjustability through selective use the accompanying bottom insert 14, attention is now drawn to the use of the head pillow 12, preferably together with the lumbar pillow 16, which may likewise be composed of a unitary body of foam material (e.g. latex foam), and may be of the particular shape profile shown in the present drawings, or may be of other known or workable shapes, for example including shapes embodied by existing commercially available lumbar pillows. In view of this, the particular shape of the illustrated lumber pillow 16 is not further described herein in any notable detail.

FIGS. 2A and 2B illustrate use of the head pillow by two different side sleepers, one with and one without the bottom insert 14, and both in combination with the optionally included lumbar pillow 16. The lower one of the user's two shoulders, meaning the lower shoulder $S_L$ resting atop the sleep surface S, is tucked into the shoulder cavity 54 of the head pillow 12 at the front side 18 thereof. Above the shoulder cavity 54, the neck-support ledge 32 juts into the space between the user's tucked-in lower shoulder $S_L$ and the user's neck N. Here, the side of user's neck N rests atop the flat plateau 40 of the head pillow's topside 26, thereby holding the user's neck N in a proper and straight alignment, preferably with full support of vertebra C1 through C7, T1 and T2. The concave curvature at the mid-region 46 of the head pillow 12 serves as a gentle crater for comfortable resting of the lower side of the user's head $H_U$, while the mid-region's downward and rearward slope encourages elongation of the user's neck N, allowing better blood flow to the head, brain and neck muscles, to help reduces headaches, sore neck symptoms, etc. A user may initially setup of the head pillow with the bottom insert 14 in place to achieve the greater effective working height $H_1$ of the head pillow, and test the resulting sleeping posture. If the user finds that the insert-aided filled-cavity working height $H_1$ feels too elevated, e.g. imparting to much inclination to the neck, then the bottom insert 14 can be removed to adopt the lesser empty-cavity working height $H_2$. Preferably the head pillow and insert are cooperatively dimensioned to fit together within a standard pillow case.

The novel head pillow design is believed to be particularly effective to achieve restorative rest so that the muscles can recuperate from holding one's weary head up all day. Through elongation of those muscles and vertebrae, the head pillow 12 is believed to contribute to better motion and reducing/minimizing stiff neck symptoms, including possible sharp pains, or even help with debilitating injuries such as pinched nerves, or more serious bulging or grinding disks.

The overall effective result is believed to be even more significant when the novel head pillow 12 is used in combination with the lumbar pillow 16, which can support vertebrae L1-L5, the sacrum and the coccyx, collectively known as the lumber region between where the rib cage ends and the hip begins. The lumbar pillow 16 supports the muscles and vertebrae which allow one to twist and bend, and by letting these muscles and vertebrae relax and elongate, it allows both more blood flow for optimal recuperations, allows the aforementioned vertebrae to stretch out, helping to remove trapped gases between them and relieve the buildup of compression. With this added support, the lumbar vertebra can both maintain the natural lumbar curvature and help compensate for body mass and mattress compression. A mattress will compress according to weight and size of one's stomach and hip size. If one's stomach is a bit oversized, the lumbar will rest in a "C" shape; or if one's hips are slightly oversized, the lower portion will dip down; either of which prevents the lumbar from maintaining its proper shape. Each compromising rest position may result in not just a stiff and sore lower back, but may result in more serious conditions such as compressed discs resulting in herniated or degenerated discs or a disc herniation. Both conditions are serious debilitating conditions that will prevent one from enjoying a comfortable and peaceful mind and body.

While the bottom insert 14 of the illustrated embodiment is of identically shaped and dimensioned relation to the bottom cavity 54 of head pillow, and therefore has an insert height $H_1$ of equal measure to the cavity height $H_C$, conformingly fills the entirety of the bottom cavity 54, and places the bottom of the insert 14 flush with the cavity-neighbouring seating surfaces 50, 54 of the head pillow's underside 28, other embodiments may differ in any one or more of these aspects.

In one alternative embodiment, the height $H_1$ of the bottom insert 14 may instead be greater than the height $H_C$ of the head pillow's bottom cavity 54. In such instance, in the installed working position of the bottom insert 14 in the bottom cavity 54 of the head pillow 12, a lower region of the insert, including the flat bottom thereof, would reside outside the bottom cavity 54 in protruding relation therefrom. The flat bottom of the insert would thus be in downwardly offset from the lowermost plane of the head pillow 12, and thus downwardly offset from the two flat seating surfaces 50, 52 of the head pillow's underside 28. In such case, this taller and protruding bottom insert, rather than the head pillow itself, would rest on the sleeping surface, and serve as a booster to head pillow, elevating it upwardly from the sleeping surface. A taller protruding insert of this type would obviously not be formed, at least not entirely, from a cut-out piece of the head pillow's foam body. Such taller protruding insert may be one of multiple inserts, for example provided in combination with the cavity-matching insert of the illustrated embodiment, whereby the head pillow and two interchangeable inserts would make the head pillow capable of three different working heights, instead of only two. A plurality of interchangeable protruding inserts of varying height, or nestable/stackable inserts, may be provided to enable a multitude of different boosted pillow heights.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. A pillow apparatus comprising:

a head pillow having a front side, a rear side of opposing relation to the front side in a longitudinal direction, a left side, a right side of opposing relation to the left side in a lateral direction perpendicularly transverse to the longitudinal direction, a topside, and an underside of opposing relation to the topside in a height direction lying orthogonally of the longitudinal and lateral directions;

wherein a cross-sectional shape of the head pillow, in a reference plane cutting therethrough in the longitudinal direction and lying parallel to the longitudinal and height directions, is characterized by:

at a top-frontal region of the head pillow that interjoins the topside and the front side, a forwardly protruding neck-support ledge, below which the front side is characterized by a rearwardly recessed shoulder cavity that is of undercut relation to the forwardly protruding neck-support ledge, and that spans from an underside of the forwardly protruding neck-support ledge to the underside of the head pillow;

at said neck-support ledge, a transitional top-front corner that curves convexly forward and downward from the topside of the head pillow to a front face of the neck-support ledge at the front side of the head pillow;

at the topside of the head pillow, and extending rearwardly from the transitional top-front corner of the neck-support ledge, a substantially flat plateau;

at the topside of the head pillow, and extending rearwardly from the substantially flat plateau toward the rear side of the head pillow, a downwardly sloped mid-region of upwardly concave curvature; and at the topside of the head pillow, and extending rearwardly from the downwardly sloped mid-region is a rear region that is of flatter profile than said downwardly-sloped mid-region and resides closer to the rear side of the pillow than to the substantially flat plateau, wherein said flatter profile joins directly with the concave curvature of the downwardly sloped mid-region with no intervening convexity between said concave curvature of the mid-region and said flatter profile of the rear region, and a rear height of the head pillow measured from the underside thereof to the topside thereof at said rear region of flatter profile is greater than a height of the shoulder cavity as measured from said underside of the head pillow to the forwardly protruding neck-support ledge.

2. The pillow apparatus of claim 1 wherein a thickness of the pillow in the height direction is greater at the rear region than at a longitudinal midpoint of the mid-region.

3. The pillow apparatus of claim 1 wherein the plateau lies in a plane of parallel relation to the longitudinal and lateral directions.

4. The pillow apparatus of claim 1 wherein at least part of the plateau resides rearwardly of the shoulder cavity.

5. The pillow apparatus of claim 1 wherein the plateau resides nearer to the front face of the neck-support ledge than to a lateral midplane of the head pillow.

6. The pillow apparatus of claim 1 wherein a front facing wall of the shoulder cavity occupies a lateral reference plane, and the plateau is intersected by said lateral reference plane.

7. The pillow apparatus of claim 6 wherein the lateral reference plane intersects said plateau at a front end thereof where said plateau meets the transitional top-front corner.

8. The pillow apparatus of claim 1 wherein the top-front transitional corner, the plateau and the downwardly curved mid-region collectively span more than half of a total length of the head pillow, as measured in the longitudinal direction.

9. The pillow apparatus of claim 1 wherein:

the underside of the head pillow is characterized by a bottom cavity recessed upwardly therein;

the apparatus further comprises a bottom insert selectively insertable into the bottom cavity to modify a compressive load resistance of the head pillow that determines a loaded working height thereof under loading of the head pillow with weight of a user's head, wherein said bottom cavity and said recess are cooperatively shaped such that an unloaded height of the head pillow in absence of said unloading is unchanged by presence or absence of the bottom insert in said bottom cavity.

10. The pillow apparatus of claim 9 wherein the bottom insert is sized and shaped so that an entirety of the bottom insert, in an installed working position thereof received within the bottom cavity of the head pillow, fits entirely within said bottom cavity of the head pillow, and a ceiling of the bottom cavity rests in contact with a topside of the bottom insert over a full longitudinal measure of the bottom insert.

11. The pillow apparatus of claim 10 wherein the bottom cavity of the head pillow and the bottom insert are of matching cross-sectional shape and size to one another such that, in the installed working position of the bottom insert, an entirety of the bottom cavity is filled by said bottom insert.

12. The pillow apparatus of claim 9 wherein a thickness of the pillow in the height direction is greater at the rear region than at a longitudinal midpoint of the mid-region, at which longitudinal mid-point said thickness is measured from a ceiling of the bottom cavity to the topside of the pillow.

13. The pillow apparatus of claim 9 wherein the underside of the head pillow comprises front and rear seating surfaces respectively situated in front of and behind the bottom cavity, and the bottom cavity and the bottom insert are cooperatively sized and shaped such that the head pillow rests on both of said front and rear seating surfaces in both a presence and absence of the bottom insert in the bottom cavity.

14. A method of producing the pillow apparatus of claim 9 comprising cutting the bottom insert from a foam body of the head pillow, thereby simultaneously forming said bottom insert and said bottom cavity in matching shape profiles to one another.

15. A pillow apparatus comprising:

a head pillow having a front side, a rear side of opposing relation to the front side in a longitudinal direction, a left side, a right side of opposing relation to the left side in a lateral direction perpendicularly transverse to the longitudinal direction, a topside, and an underside of opposing relation to the topside in a height direction lying orthogonally of the longitudinal and lateral directions;

a bottom cavity recessed upwardly in the underside of the head pillow; and a bottom insert selectively insertable into the bottom cavity to modify a compressive load resistance of the head pillow that determines a loaded working height thereof under loading of the head pillow with weight of a user's head, said bottom cavity and said recess being cooperatively sized and shaped such that an unloaded height of the head pillow in absence of said loading is unchanged by a presence or absence of the bottom insert in said bottom cavity.

16. The pillow apparatus of claim 15 wherein the bottom insert is sized and shaped so that an entirety of the bottom insert, in an installed working position thereof received within the bottom cavity of the head pillow, fits entirely within said bottom cavity of the head pillow, and a ceiling of the bottom cavity rests in contact with a topside of the bottom insert over a full longitudinal measure of the bottom insert.

17. The pillow apparatus of claim 15 wherein the bottom cavity of the head pillow and the bottom insert are of matching cross-sectional shape and size to one another such that, in the installed working position of the bottom insert, an entirety of the bottom insert is filled by the bottom insert.

18. A method of producing the pillow apparatus of claim 15 comprising cutting the bottom insert from a foam body of the head pillow, thereby simultaneously forming said bottom insert and said bottom cavity in matching shape profiles to one another.

19. The pillow apparatus of claim 15 wherein the underside of the head pillow comprises front and rear seating surfaces respectively situated in front of and behind the bottom cavity, and the bottom cavity and the bottom insert are cooperatively shaped such that the head pillows rests on both of said front and rear seating surfaces in both a presence and absence of the bottom insert in the bottom cavity.

* * * * *